United States Patent [19]

Uhri

[11] Patent Number: 4,718,490

[45] Date of Patent: Jan. 12, 1988

[54] CREATION OF MULTIPLE SEQUENTIAL HYDRAULIC FRACTURES VIA HYDRAULIC FRACTURING COMBINED WITH CONTROLLED PULSE FRACTURING

[75] Inventor: Duane C. Uhri, Grand Prairie, Tex.

[73] Assignee: Mobil Oil Corporation, New York, N.Y.

[21] Appl. No.: 946,236

[22] Filed: Dec. 24, 1986

[51] Int. Cl.[4] ..... E21B 33/138; E21B 43/26; E21B 43/263; E21B 43/28

[52] U.S. Cl. ..... 166/281; 166/271; 166/299; 299/5

[58] Field of Search ..... 166/250, 263, 271, 287, 166/300, 299, 281; 299/5

[56] References Cited

U.S. PATENT DOCUMENTS

| | | | |
|---|---|---|---|
| 3,537,529 | 11/1970 | Timmerman | 166/281 X |
| 3,613,789 | 10/1971 | Son, Jr. | 166/281 |
| 3,863,709 | 2/1975 | Fitch | 166/271 |
| 3,896,879 | 7/1975 | Sareen et al. | 166/308 |
| 4,005,750 | 2/1977 | Shuck | 166/308 |
| 4,015,663 | 4/1977 | Strubhar | 166/258 |
| 4,019,577 | 4/1977 | Fitch et al. | 166/259 |
| 4,067,389 | 1/1978 | Savins | 166/308 X |
| 4,109,721 | 8/1978 | Slusser | 166/280 |
| 4,143,715 | 3/1979 | Pavlich | 166/281 X |
| 4,333,461 | 6/1982 | Muller | 128/284 |
| 4,548,252 | 10/1985 | Stowe et al. | 166/299 |

*Primary Examiner*—George A. Suchfield
*Attorney, Agent, or Firm*—Alexander J. McKillop; Michael G. Gilman; Charles A. Malone

[57] ABSTRACT

A process for sequentially fracturing a subterranean formation containing desired natural resources in which controlled pulse fracturing (CPF) is combined with hydraulic fracturing in the same wellbore. After multiple radial vertical fractures have been created by CPF, a solidifiable gel material is directed into the created fractures during a subsequent hydraulic fracturing procedure. During this procedure, multiple vertical hydraulic fractures initiate in and propagate away from the CPF created fractures thereby bringing the wellbore into communication with the desired natural resources.

20 Claims, 1 Drawing Figure

CREATION OF MULTIPLE SEQUENTIAL HYDRAULIC FRACTURES VIA HYDRAULIC FRACTURING COMBINED WITH CONTROLLED PULSE FRACTURING

FIELD OF THE INVENTION

This invention relates to a method for extending multiple radial fractures obtained in a single wellbore during controlled pulse fracturing (CPF) of an underground formation by subsequent utilization of a blocking agent and hydraulic fracturing in such a manner as to create multiple sequential hydraulic fractures.

BACKGROUND OF THE INVENTION

It has been known for some time that the yield of hydrocarbons, such as gas and petroleum, from wells can be increased by fracturing the formation so as to stimulate the flow of hydrocarbons into the well. Various formation fracturing procedures have been proposed and many now are in use. Among these procedures are treatments with various chemicals (usually acids in aqueous solutions), hydraulic fracturing in which liquids are injected under high pressure (usually with propping agents), explosive methods in which explosives are detonated within a formation to effect mechanical fracture, and combinations of the above procedures.

A combustion method designed to stimulate a well through mechanical fracturing is known as controlled pulse fracturing (CPF) or high energy gas fracturing. A good description of this method appears in an article by Cuderman, J. F., entitled "High Energy Gas Fracturing Development," Sandia National Laboratories, SAND 83-2137, October 1983. Using this method enables the multiple fracturing of a formation or reservoir in a radial manner which increases the possibility of contacting natural fractures. Unfortunately, these radial fractures often do not penetrate deeply enough into the formation.

A hydraulic fracturing method designed to control fracture trajectories in a formation penetrated by two closely-spaced wells is known as sequential hydraulic fracturing. In sequential hydraulic fracturing, the direction that a hydraulic fracture will propagate is controlled by altering the local in-situ stress distribution in the vicinity of the first wellbore. By this method, a hydraulic fracturing operation is conducted at the first wellbore wherein a hydraulic pressure is applied to the formation sufficient to cause a hydraulic fracture to form perpendicular to the least principal in-situ stress. While maintaining pressure in this first hydraulic fracture, a second hydraulic fracture is initiated in the second wellbore. This second hydraulic fracture, due to the alteration of the local in-situ stresses by the first hydraulic fracture will initiate at an angle, possibly perpendicular, to the first hydraulic fracture. In propagating, this second hydraulic fracture then has the potential of intersecting natural fractures not contacted by the first hydraulic fracture, thereby significantly improving the potential for enhanced hydrocarbon production and cumulative recovery.

Therefore, what is needed is a method which combines both CPF and sequential hydraulic fracturing techniques in order to extend these controlled pulse fractures so as to permit removal of increased amounts of natural resources from an underground formation. Practicing the present invention will allow for the creation of fracture extensions emanating from CPF induced radial fractures so as to connect with natural fractures and allow for the production of increased amounts of natural resources from a formation. Even in the absence of natural fractures, productivity will be increased due to the additional multiple fracture surface areas created by practicing this invention.

SUMMARY OF THE INVENTION

This invention is directed to a method for extending multi-azimuth vertical radial fractures resultant from CPF treatments. To accomplish this, multiple vertical radial fractures are created in a subterranean formation by energy resultant from a CPF method. These multiple radial fractures are short in length. Following the CPF treatment, hydraulic pressure is applied to the wellbore in an amount sufficient to fracture the formation. Upon commencement of the hydraulic fracturing treatment, a first hydraulic fracture is initiated from the CPF created radial fracture which is closest to being substantially perpendicular to the least principal in-situ stress.

While maintaining the hydraulic pressure on the formation and propagating this first hydraulic fracture, alternating slugs of thin-fluid spacer and gelled proppant slurry, or quick-setting blocking polymer, with or without proppant, are pumped into this fracture. After penetrating into the formation for a substantial distance, this first instituted hydraulic fracture "screens out", thereby preventing additional fluid from entering the fracture.

The pumping rate and hydraulic pressure are maintained and not allowed to drop thereby causing a second hydraulic fracture to be initiated. The second hydraulic fracture initiates from the tip of another radial fracture. The specific radial fracture from which a hydraulic fracture will be initiated is that fracture which has the least closure stress resulting from the interaction of the first hydraulic fracture and the original in-situ stress. This second hydraulic fracture has a trajectory which curves away from the first hydraulic fracture and is subsequently propagated perpendicular to the least principal in-situ stress. As was done with the first hydraulic fracture, the second hydraulic fracture is propagated while pumping alternating slugs of spacer fluid and a temporary blocking agent with proppant therein.

Once the second fracture screens out, a third hydraulic fracture originates from the tip of the next radial fracture which has the least closure stress resulting from the interaction of said first and second hydraulic fractures and the original in-situ stress. Hydraulic fracturing pressure and the pumping rate are maintained as above mentioned and another curved fracture is propagated. These steps are repeated until a sufficient number of desired propped sequential hydraulic fractures are induced in the formation. Thereafter, increased volumes of desired natural resources are produced from the formation, particularly hydrocarbonaceous fluids.

It is therefore an object of this invention to create more than two simultaneous multiple radial vertical fractures near a wellbore in a formation.

It is another object of this invention to avoid damaging the rock near the wellbore when creating said multiple radial vertical fractures.

It is yet another further object of this invention to cause multiple hydraulic fractures to communicate with a natural fracture system.

It is yet another further object of this invention to obtain increased quantities of natural resources from a formation, particularly hydrocarbonaceous fluids.

It is a still further object of this invention to locally alter in-situ stress conditions and produce multiple vertical propped permeable sequential hydraulic fractures which curve away from the wellbore in different directions.

It is still yet another object of this invention to extend multiple vertical radial fractures resultant from controlled pulse fracturing (CPF) by application of hydraulic fracturing in combination with temporary blocking agents.

DESCRIPTION OF THE PREFERRED EMBODIMENTS

Figure 1:
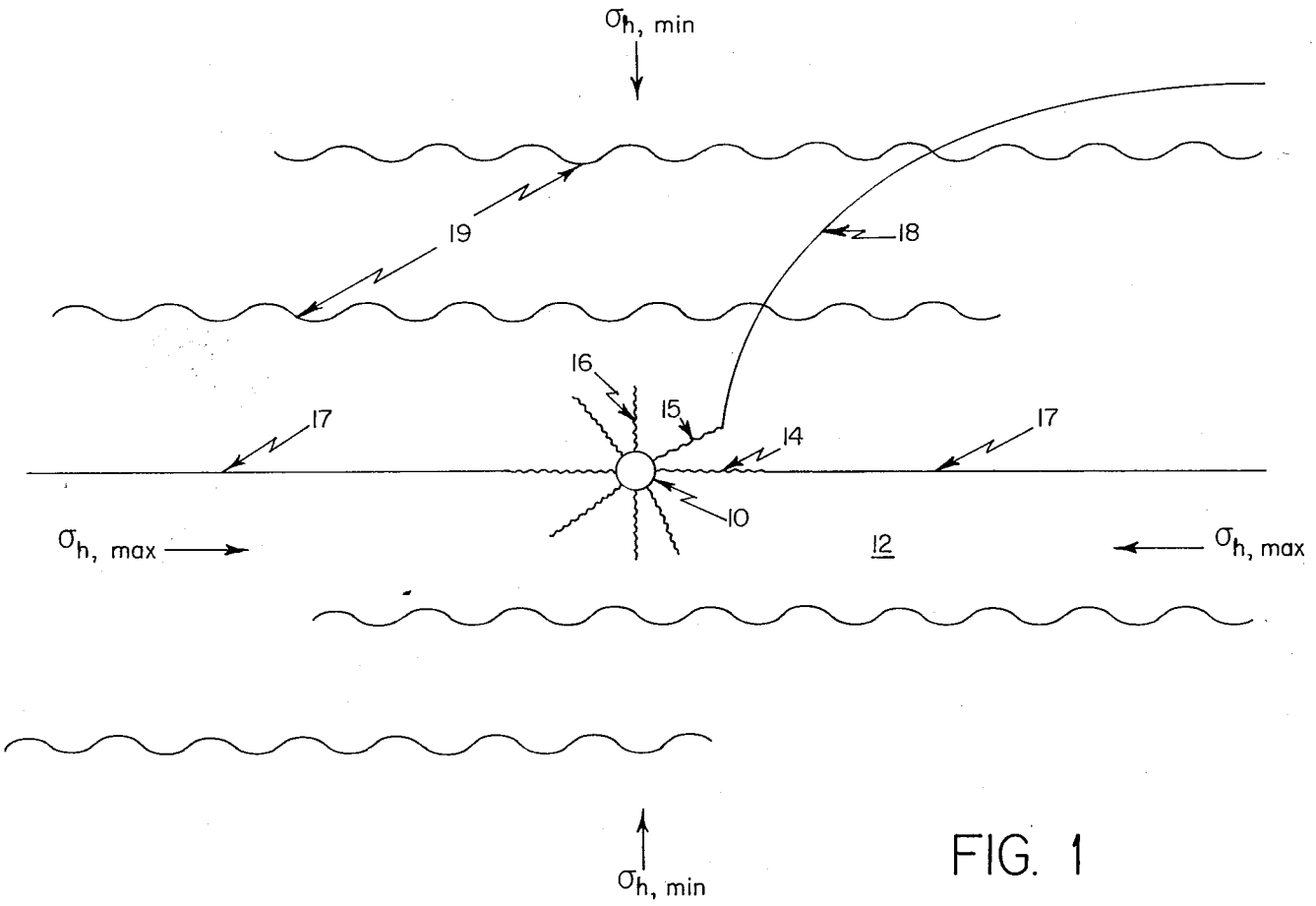
FIG. 1, is a schematic representation of a wellbore in a formation wherein multiple radial vertical fractures have been generated by controlled pulse fracturing (CPF). First and second hydraulic fractures formed subsequent to the CPF treatment are illustrated to show where the second hydraulic fracture communicates with a natural fracture system.

In the practice of this invention, referring to the drawing, a wellbore 10 is directed vertically into formation 12. Thereafter, a controlled pulse fracturing (CPF) method is utilized to produce more than two simultaneous multiple radial vertical fractures 14, 15, and 16 which originate at wellbore 10 and penetrate formation 12.

Once the CPF treatment has been completed, hydraulic fracturing is initiated by injecting alternating slugs of a thin-fluid spacer and a temporary blocking agent containing proppant into the wellbore 10. This temporary blocking agent is either a viscous hydraulic fracturing gel or a quick-setting temporary blocking polymer, both of which are well-known to those skilled in the art of hydraulic fracturing. When the injection fluid treating pressure applied to wellbore 10 is sufficient to fracture formation 12, a first hydraulic fracture 17 is initiated from the CPF created radial vertical fracture 14 which is closest to being substantially perpendicular to the least principal horizontal in-situ stress, "$\sigma_h$, min" as indicated in the drawing. The Maximum principal horizontal in-situ stress is designated in the drawing as "$\sigma_h$ max". Each of these principal horizontal in-situ stresses is considered to be less than the vertical in-situ stress.

While maintaining pressure in the first hydraulic fracture 17 and propagating this fracture into formation 12, alternating slugs of a thin-fluid spacer and a temporary blocking agent containing proppant therein are injected into this fracture via wellbore 10. As this first hydraulic fracture 14 propagates, the thin-fluid spacer leaks off into the permeable formation 12, leaving behind the temporary blocking agent containing said proppant so as to eventually form a propped fracture 14 that cannot accept any more fluids. Proppants and methods for packing said proppants are discussed in U.S. Pat. No. 4,109,721 issued to Slusser on Aug. 29, 1978. This patent is hereby incorporated by reference. Said proppant should be of a size sufficient to prop any resultant fractures, and be about 10 to about 40 U.S. mesh size. Sand of about this mesh size can be used. The injected fluid is then automatically diverted due to this "screen out" phenomenon to another CPF created radial vertical fracture 15. The thin-fluid spacer can comprise water, diesel oils, alcohols, high gravity crude oils, petroleum distillates, aqueous acid solutions, and mixtures thereof.

The pumping rate and hydraulic pressure are maintained in wellbore 10 and not allowed to drop thereby causing a second hydraulic fracture 18 to initiate from CPF created radial vertical fracture 15. This second hydraulic fracture 18 emanates from the tip of CPF fracture 15 since CPF fracture 15 now exhibits the least closure stress due to the interaction of blocked first hydraulic fracture 17 and the original in-situ stresses. This second hydraulic fracture 18 has a trajectory which curves away from the first hydraulic fracture 17 and is subsequently propagated perpendicular to the least principal in-situ stress $\sigma_h$, min. after intersecting natural fractures 19.

As was done with the first hydraulic fracture 17, the second hydraulic fracture 18 is propagated while pumping alternating slugs of a thin-fluid spacer and temporary blocking agent with proppant therein into wellbore 10. Once the second hydraulic fracture 18 screens out, a third hydraulic fracture originates from the tip of the CPF created radial vertical fracture which has the least closure stress resulting from the interaction of stresses from the first hydraulic fracture 17, the second hydraulic fracture 18, and the original in-situ stresses. Hydraulic fracturing pressure and the pumping rate are maintained as above and another curved fracture is propagated. These steps are repeated until a desired number of propped permeable sequential hydraulic fractures are created in formation 12 via wellbore 10.

As is known to those skilled in the art, multiple radial vertical fractures can be created at the wellbore and extended into the formation without crushing the formation adjacent to the wellbore when a propellant is utilized. A propellant means for creating more than two simultaneous multiple radial vertical fractures is placed in the well or wellbore substantially near the productive interval and ignited. As is known to those skilled in the art, the pressure loading rate is the primary parameter for the production of multiple fractures. The loading rate required to produce multiple fractures is an inverse function of well-bore or hole diameter. Hot gases are formed in the wellbore or borehole upon ignition of a propellant means thereby creating a pressure capable of fracturing rock formations. A method for creating said multiple radial vertical fractures by controlled pulse fracturing (CPF) is disclosed in U.S. Pat. No. 4,548,252 which issued to Stowe et al. on Oct. 22, 1985. This patent is hereby incorporated by reference.

In this present invention, a temporary blocking agent is utilized. One method for making a suitable temporary blocking agent is discussed in U.S. Pat. No. 4,333,461 which issued to Mueller on June 8, 1982 which patent is hereby incorporated by reference. The stability and rigidity of the temporary blocking agent will depend upon the physical and chemical characteristics desired to be obtained. As is known to those skilled in the art, the temporary blocking agent should be of a stability and rigidity sufficient to withstand environmental conditions encountered in the formation. The temporary blocking agent which is utilized can comprise a solidifiable gel which breaks with about 0.5 to about 4 hours.

A hydraulic fracturing technique which can be used in the practice of this invention is disclosed by Savins in U.S. Pat. No. 4,067,389 which issued on Jan. 10, 1978. This patent is hereby incorporated by reference.

The process of this invention can be utilized in many applications. These applications include removal of desired resources from a formation containing geothermal energy, tar sands, coal, oil shale, iron ore, uranium ore, and, as is preferred, hydrocarbonaceous fluids. The steps of this invention can be practiced until a desired number of sequential hydraulic fractures have been created which fractures communicate with a natural fracture or fractures in a resource bearing formation which fractures thereby communicate with a wellbore. Once in the wellbore a desired resource can be produced to the surface.

Sareen et al. in U.S. Pat. No. 3,896,879 disclose a method for increasing the permeability of a subterranean formation penetrated by at least one well which extends from the surface of the earth into the formation. Via this method, an aqueous hydrogen peroxide solution, containing therein a stabilizing agent is injected through said well into the subterranean formation. After injection, the solution diffuses into the fractures of the formation surrounding the well. The stabilizing agent reacts with metal values in the formation which allows the hydrogen peroxide to decompose. The decomposition of hydrogen peroxide generates a gaseous medium causing additional fracturing of the formation. Sareen et al. were utilizing a method for increasing the fracture size to obtain increased removal of copper ores from a formation. This patent is hereby incorporated by reference. Utilization of the present invention will increase the communication between the wellbore and natural resources in the formation by hydraulic extension of the fractures resultant from controlled pulse fracturing (CPF).

In addition to removing ores, particularly copper ores and iron ores from a formation, the present invention can be used to recover geothermal energy more efficiently by the creation of more fracture surface area. A method for recovering geothermal energy is disclosed in U.S. Pat. No. 3,863,709 which issued to Fitch on Feb. 4, 1975. This patent is hereby incorporated by reference. Disclosed in this patent is a method and system for recovering geothermal energy from a subterranean geothermal formation having a preferred vertical fracture orientation. At least two deviated wells are provided which extend into the geothermal formation in a direction transverse to the preferred vertical fracture orientation. A plurality of vertical fractures are hydraulically formed to intersect the deviated wells. A fluid is thereafter injected via one well into the fractures to absorb heat from the geothermal formation and the heated fluid is recovered from the formation via another well.

The present invention can also be used to remove thermal energy produced during in-situ combustion of coal by the creation of additional fracture surface area. A method wherein thermal energy so produced by in-situ combustion of coal is disclosed in U.S. Pat. No. 4,019,577 which issued to Fitch et al. on Apr. 26, 1977. This patent is hereby incorporated by reference. Disclosed therein is a method for recovering thermal energy from a coal formation which has a preferred vertical fracture orientation.

Recovery of thermal energy from subterranean formations can also be used to generate steam. A method for such recovery is disclosed in U.S. Pat. No. 4,015,663 which issued to Strubhar on Apr. 5, 1977. This patent is hereby incorporated by reference.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed is:

1. A method for creating multiple sequential hydraulic fractures via hydraulic fracturing combined with controlled pulse fracturing comprising:

(a) creating more than two simultaneous multiple vertical radial fractures via a controlled pulse fracturing method;

(b) applying thereafter hydraulic pressure to the formation in an amount sufficient to fracture said formation thereby forming a first hydraulic fracture perpendicular to the least principal horizontal in-situ stress where said first fracture originates from the tip of a controlled pulse fracture that is substantially perpendicular to the least principal horizontal in-situ stress;

(c) maintaining said hydraulic pressure on the formation while pumping alternate slugs of a thin-fluid spacer and a temporary blocking agent having a proppant therein into said fracture until said fracture screens out whereupon a second hydraulic fracture is initiated at the tip of another controlled pulse fracture which then exhibits the least closure stress due to the alteration of the local in-situ stresses caused by said first hydraulic fracture;

(d) maintaining said hydraulic pressure on said formation while pumping alternate slugs of said thin-fluid spacer and said blocking agent into said second hydraulic fracture thereby causing said second hydraulic fracture to propagate away from said first hydraulic fracture in a curved trajectory which eventually becomes substantially perpendicular to the original least principal in-situ stress due to the interaction of the original in-situ stresses and stress from said first hydraulic fracture in combination with stress from said second hydraulic fracture;

(e) maintaining said hydraulic pressure on said formation while pumping alternate slugs of said thin-fluid spacer and said blocking agent into said last formed hydraulic fracture until this fracture screens out whereupon another hydraulic fracture initiates at the tip of another controlled pulse fracture which then exhibits the least closure stress due to alteration of the local in-situ stresses by all previously formed hydraulic fractures;

(f) maintaining said hydraulic pressure on said formation while pumping alternate slugs of said thin-fluid spacer and said blocking agent into said last formed hydraulic fracture to cause said last formed hydraulic fracture to propagate away from said previously formed hydraulic fractures in a curved trajectory which eventually becomes substantially perpendicular to the said original least principal in-situ stress due to the interaction of said original in-situ stresses and stresses from previously formed hydraulic fractures with said last formed hydraulic fracture; and (g) repeating steps (e) and (f) until a desired number of curved sequential hydraulic fractures are created as extensions to said multiple vertical radial fractures obtained in step (a).

2. The method as recited in claim 1 wherein step (c) said thin-fluid spacer comprises water, diesel oils, alcohols, high gravity crude oils, petroleum distillates, aqueous acid solutions, and mixtures thereof.

3. The method as recited in claim 1 wherein step (c) said temporary blocking agent comprises a solidifiable gel which breaks within about 0.5 to 4 hours.

4. The method as recited in claim 1 where resources are removed from an underground formation which resources comprise geothermal energy, oil shale, coal, tar sand, copper ore, iron ore, uranium ore and hydrocarbonaceous fluids.

5. The method as recited in claim 1 where steps (e) and (f) are repeated until a desired number of sequential hydraulic fractures have been created which fractures communicate with natural fractures in a resource bearing formation which thereby communicate with a wellbore.

6. The method as recited in claim 1 wherein step (c) the proppant comprises sand in the range of about 10 to about 40 U.S. mesh size.

7. A method for creating multiple sequential hydraulic fractures via hydraulic fracturing combined with controlled pulse fracturing comprising:

(a) creating simultaneous multiple vertical radial fractures via a controlled pulse fracturing method;

(b) applying thereafter hydraulic pressure to the formation in an amount sufficient to fracture said formation thereby forming a first hydraulic fracture perpendicular to the least principal in-situ stress where said first fracture originates from the tip of a controlled pulse fracture that is substantially perpendicular to the least principal in-situ stress; and (c) maintaining the hydraulic pressure on the formation while pumping alternate slugs of a thin-fluid spacer and a temporary blocking agent having a proppant therein into said fracture until said fracture screens out whereupon a second hydraulic fracture is initiated at the tip of another controlled pulse fracture which then exhibits the least closure stress due to the alteration of the local in-situ stresses caused by said first hydraulic fracture.

8. The method as recited in claim 7 wherein step (c) said thin-fluid spacer comprises water, diesel oils, alcohols, high gravity crude oils, petroleum distillates, aqueous acid solutions, and mixtures thereof.

9. The method as recited in claim 7 wherein step (c) said temporary blocking agent comprises a solidifiable gel which breaks within about 0.5 to 4 hours.

10. The method as recited in claim 7 where resources are removed from an underground formation which resources comprise geothermal energy, oil shale, coal, tar sand, copper ore, iron ore, uranium ore and hydrocarbonaceous fluids.

11. The method as recited in claim 7 where steps (b) and (c) are repeated until a desired number of sequential hydraulic fractures have been created which fractures communicate with natural fractures in a resource bearing formation which thereby communicate with a wellbore.

12. The method as recited in claim 7 wherein step (c) the proppant comprises sand in the range of about 10 to about 40 U.S. mesh size.

13. The method as recited in claim 7 where the least principal in-situ stress is horizontal.

14. A method for creating multiple sequential hydraulic fractures via hydraulic fracturing combined with controlled pulse fracturing comprising:

(a) creating simultaneous multiple vertical radial fractures via a controlled pulse fracturing method;

(b) applying thereafter hydraulic pressure to the formation in an amount sufficient to fracture said formation thereby forming a first hydraulic fracture perpendicular to the least principal in-situ stress where said first fracture originates from the tip of a controlled pulse fracture that is substantially perpendicular to the least principal in-situ stress;

(c) maintaining the hydraulic pressure on the formation while pumping alternate slugs of a thin-fluid spacer and a temporary blocking agent having a proppant therein into said fracture until said fracture screens out whereupon a second hydraulic fracture is initiated at the tip of another controlled pulse fracture which then exhibits the least closure stress due to the alteration of the local in-situ stresses caused by said first hydraulic fracture;

(d) maintaining said hydraulic pressure on said formation while pumping alternate slugs of said thin-fluid spacer and said blocking agent into said second hydraulic fracture thereby causing said second hydraulic fracture to propagate away from said first hydraulic fracture in a curved trajectory which eventually becomes substantially perpendicular to the said original least principal in-situ stress due to the interaction of the original in-situ stresses and stress from said first hydraulic fracture in combination with stress from said second hydraulic fracture;

(e) maintaining said hydraulic pressure on said formation while pumping alternate slugs of said thin-fluid spacer and said temporary blocking agent into the last formed hydraulic fracture until this fracture screens out whereupon another hydraulic fracture initiates at the tip of another controlled pulse fracture which then exhibits the least closure stress due to alteration of the local in-situ stresses by all previously formed hydraulic fractures, and (f) maintaining said hydraulic pressure on said formation while pumping alternate slugs of said thin-fluid spacer and said blocking agent into said last formed hydraulic fracture to cause said last formed hydraulic fracture to propagate away from said previously formed hydraulic fractures in a curved trajectory which eventually becomes substantially perpendicular to the said original least principal in-situ stress due to the interaction of said original in-situ stresses and stresses from said previously formed hydraulic fractures with said last formed hydraulic fracture.

15. The method as recited in claim 14 wherein step (c) said thin-fluid spacer comprises water, diesel oils, alcohols, high gravity crude oils, petroleum distillates, aqueous acid solutions, and mixtures thereof.

16. The method as recited in claim 14 wherein step (c) said temporary blocking agent comprises a solidifiable gel which breaks within about 0.5 to 4 hours.

17. The method as recited in claim 14 where resources are removed from an underground formation which resources comprise geothermal energy, oil shale, coal, tar sand, copper ore, iron ore, uranium ore and hydrocarbonaceous fluids.

18. The method as recited in claim 14 where steps (e) and (f) are repeated until a desired number of sequential hydraulic fractures have been created which fractures communicate with natural fractures in a resource bearing formation which thereby communicate with a wellbore.

19. The method as recited in claim 14 wherein step (c) the proppant comprises sand in the range of about 10 to about 40 U.S. mesh size.

20. The method as recited in claim 14 where the last principal in-situ stress is horizontal.

* * * * *